US008800573B2

(12) United States Patent
Hofstad

(10) Patent No.: US 8,800,573 B2
(45) Date of Patent: Aug. 12, 2014

(54) COMBINED ARTICLE FOR PERSONAL HYGIENE

(76) Inventor: Stein Hofstad, Trondheim (NO)

( * ) Notice: Subject to any disclaimer, the term of this patent is extended or adjusted under 35 U.S.C. 154(b) by 0 days.

(21) Appl. No.: 12/745,916

(22) PCT Filed: Dec. 11, 2008

(86) PCT No.: PCT/NO2008/000442

§ 371 (c)(1),
(2), (4) Date: Jun. 21, 2010

(87) PCT Pub. No.: WO2009/075586

PCT Pub. Date: Jun. 18, 2009

(65) Prior Publication Data

US 2010/0269277 A1 Oct. 28, 2010

(30) Foreign Application Priority Data

Dec. 13, 2007 (NO) ..... 20076434

(51) Int. Cl.

| | |
|---|---|
| ***A45D 44/18*** | (2006.01) |
| ***A45D 27/22*** | (2006.01) |
| ***B65D 69/00*** | (2006.01) |
| ***B65D 71/00*** | (2006.01) |
| ***B26B 1/00*** | (2006.01) |
| ***B26B 3/00*** | (2006.01) |
| ***A46B 5/00*** | (2006.01) |
| ***A46B 17/04*** | (2006.01) |
| ***A46B 15/00*** | (2006.01) |

(52) U.S. Cl.

CPC ..... *A46B 5/0033* (2013.01); *A45D 27/22* (2013.01); *A46B 17/04* (2013.01); *A45D 44/18* (2013.01); *A46B 5/0041* (2013.01); *A46B 15/0055* (2013.01); *A46B 15/0079* (2013.01); *A46B 2200/1066* (2013.01)

USPC ..... 132/308; 132/289; 206/581; 30/123

(58) Field of Classification Search

CPC ..... A45D 44/18; A45D 27/22; A45D 27/225; A45D 27/28; A45D 40/22; A45D 33/24; A45D 33/26; A46B 17/02; A46B 17/04; A46B 2200/1066

USPC ..... 132/308, 121, 147, 148, 73.5, 75, 76.2, 132/286, 289, 290, 294, 295, 297, 299, 300, 132/309, 310, 311, 313, 314, 315, 317, 318, 132/328, 329; 206/208, 228, 37, 581, 206/362.1, 361, 209.1, 368, 116, 470; 401/29, 30, 31, 32, 99, 117, 368, 195; 15/167.1, 105, 184, 185; 30/535, 125, 30/537, 541, 60.5, 34.05, 32, 43.91, 57, 30/58, 59, 62, 153, 84, 527, 539, 155, 28; 7/170, 118, 168, 128, 129; 81/490; D4/104, 108, 138; D8/81, 99; D28/45, D28/68; D9/748

See application file for complete search history.

(56) References Cited

U.S. PATENT DOCUMENTS

| | | | | |
|---|---|---|---|---|
| 1,084,923 | A * | 1/1914 | Bowman | 15/105 |
| 1,304,769 | A * | 5/1919 | Hendrickson | 15/185 |

(Continued)

FOREIGN PATENT DOCUMENTS

| | | |
|---|---|---|
| DE | 20014388 | 1/2001 |
| FI | 107369 | 7/2001 |

(Continued)

*Primary Examiner* — Vanitha Elgart

(74) *Attorney, Agent, or Firm* — Ladas & Parry LLP

(57) ABSTRACT

An article for personal hygiene is described, having a partly hollow holder part (2), a toothbrush part (6) and a fastening means (5) for a razor head (7). The toothbrush part (6) is arranged to be folded into the holder part (2), as the toothbrush part (6) has a first end with a hinge mechanism (13, 14), in such a way that the toothbrush part (6) is pivotally fastened to the holder part (2). In the partly hollow holder part (2) it is arranged a wall (22), constituting a physical separation between a first room (20) and a second room (21). The end of the toothbrush part (6) having a toothbrush head (23) is arranged to be folded into the first room (20). The wall (22) constitutes at the same time a fastening for a filling device (25), known per se. More air and drain holes (24, 35, 36, 34*a*, 34*b*) are preferably arranged on the article.

15 Claims, 10 Drawing Sheets

(56) References Cited

U.S. PATENT DOCUMENTS

| | | | | | |
|---|---|---|---|---|---|
| 1,357,679 | A | * | 11/1920 | Ball | 132/290 |
| 1,432,717 | A | * | 10/1922 | Miller | 15/184 |
| 1,530,070 | A | * | 3/1925 | Bovee | 132/314 |
| 1,545,542 | A | * | 7/1925 | Albrecht et al. | 30/53 |
| 2,061,430 | A | * | 11/1936 | Ley | 401/125 |
| 2,111,181 | A | * | 3/1938 | Findley | 222/93 |
| 2,112,658 | A | * | 3/1938 | Rathbun | 206/362.3 |
| 2,168,689 | A | * | 8/1939 | Smith et al. | 401/191 |
| 2,216,026 | A | * | 9/1940 | Smith | 15/144.1 |
| 2,247,003 | A | * | 6/1941 | Smith et al. | 401/191 |
| 2,294,631 | A | * | 9/1942 | Rocca | 206/362.2 |
| D134,723 | S | * | 1/1943 | Riksheim | D4/108 |
| D147,996 | S | * | 11/1947 | Stacey et al. | D4/108 |
| 2,491,207 | A | * | 12/1949 | Preble, Jr. et al. | 401/268 |
| 2,505,547 | A | * | 4/1950 | Howard | 401/191 |
| 2,599,019 | A | * | 6/1952 | Rupert | 132/289 |
| 2,657,412 | A | * | 11/1953 | Carlson | 15/185 |
| 2,702,041 | A | * | 2/1955 | McDougal et al. | 132/290 |
| 2,740,149 | A | * | 4/1956 | Carlson | 15/185 |
| 3,105,254 | A | * | 10/1963 | Benick | 15/22.1 |
| 3,349,484 | A | * | 10/1967 | Zeles | 30/47 |
| 3,613,698 | A | * | 10/1971 | Fox | 132/311 |
| 3,646,672 | A | * | 3/1972 | Braginetz | 30/32 |
| 3,734,118 | A | * | 5/1973 | Howard | 132/311 |
| 3,746,162 | A | * | 7/1973 | Bridges | 206/361 |
| 4,204,294 | A | * | 5/1980 | Halverson | 15/185 |
| 4,401,215 | A | * | 8/1983 | Kramer | 206/362.3 |
| 4,542,828 | A | | 9/1985 | Gotto | |
| 4,693,622 | A | * | 9/1987 | Booth | 401/191 |
| D294,661 | S | * | 3/1988 | Kang | D4/108 |
| 4,759,381 | A | * | 7/1988 | Cesari | 132/311 |
| 4,760,642 | A | | 8/1988 | Kwak | |
| 4,924,547 | A | * | 5/1990 | Wachtel et al. | 15/185 |
| 5,003,658 | A | * | 4/1991 | Rolleri | 15/185 |
| 5,018,543 | A | * | 5/1991 | Trillo Martinez et al. | 132/291 |
| 5,375,711 | A | * | 12/1994 | Bree et al. | 206/362.2 |
| 5,423,427 | A | * | 6/1995 | Brown | 206/581 |
| 5,465,488 | A | * | 11/1995 | Yaw et al. | 30/41 |
| 5,622,195 | A | * | 4/1997 | Lee | 132/289 |
| 5,735,298 | A | * | 4/1998 | Mayne et al. | 132/309 |
| 5,832,940 | A | | 11/1998 | Embry et al. | |
| 6,129,090 | A | * | 10/2000 | Pillar et al. | 132/309 |
| 6,206,600 | B1 | | 3/2001 | Rosenberg et al. | |
| 6,598,609 | B2 | * | 7/2003 | Gibbs | 132/289 |
| 6,675,815 | B1 | * | 1/2004 | Hofstad | 132/309 |
| 7,093,363 | B1 | * | 8/2006 | Kuo | 30/47 |
| 7,360,650 | B2 | * | 4/2008 | Hoffecker | 206/362.3 |
| 7,753,197 | B2 | * | 7/2010 | Russell | 206/228 |
| 2002/0100490 | A1 | * | 8/2002 | Bodwalk | 132/309 |
| 2003/0070259 | A1 | * | 4/2003 | Brown et al. | 16/436 |
| 2005/0150116 | A1 | * | 7/2005 | Johnson et al. | 30/162 |
| 2005/0211263 | A1 | * | 9/2005 | Kuo | 132/310 |
| 2010/0071144 | A1 | * | 3/2010 | Nanda | 15/167.1 |

FOREIGN PATENT DOCUMENTS

| | | |
|---|---|---|
| FR | 2490084 | 3/1982 |
| FR | 2653696 | 5/1991 |
| WO | 2005087047 | 9/2005 |

* cited by examiner

COMBINED ARTICLE FOR PERSONAL HYGIENE

BACKGROUND OF THE INVENTION

The present invention relates to a combined article for personal hygiene.

DESCRIPTION OF RELATED ART

Combined articles for personal hygiene, comprising a toothbrush part and a razor part is previously known in a number variants, a.o. Norwegian Patent Applications 19991855 and 20044396, and from U.S. Pat. No. 5,832,940 and U.S. Pat. No. 6,206,600.

Generally, these known devices have a relatively complicated construction, and are correspondingly expensive to manufacture. There is a need to reduce these manufacturing costs substantially. Further, there is a need for a solution involving a minimal number of loose parts, to avoid that some components are getting lost.

From WO 2005/087047 it is known a foldable toothbrush, which in folded position can get tooth paste applied from a reservoir. This known article lacks fastening possibilities for a razor, and it is not obvious to perform such fastening possibilities.

U.S. Pat. No. 4,760,642 shows a hygiene article which in one end is equipped with a toothbrush, and in the other end is equipped with a razor. The reservoirs of tooth paste and shaving spray are arranged for applying to the toothbrush and the razor, respectively. This known device is not foldable and considering the design, it is not obvious to make it foldable.

SUMMARY OF THE INVENTION

A special problem of combined hygiene articles (several functions in the same product), is to separate the different ranges of use. In known combinations of toothbrush and razor there might be a problem that remnants of water and shaving means get in contact with the toothbrush part. This is avoided with a device according to the present invention.

BRIEF DESCRIPTION OF THE DRAWINGS

The invention will in the following be described in detail by means of an example and with reference to enclosed figures, where.

DESCRIPTION OF THE PREFERRED EMBODIMENTS

Figure 1:
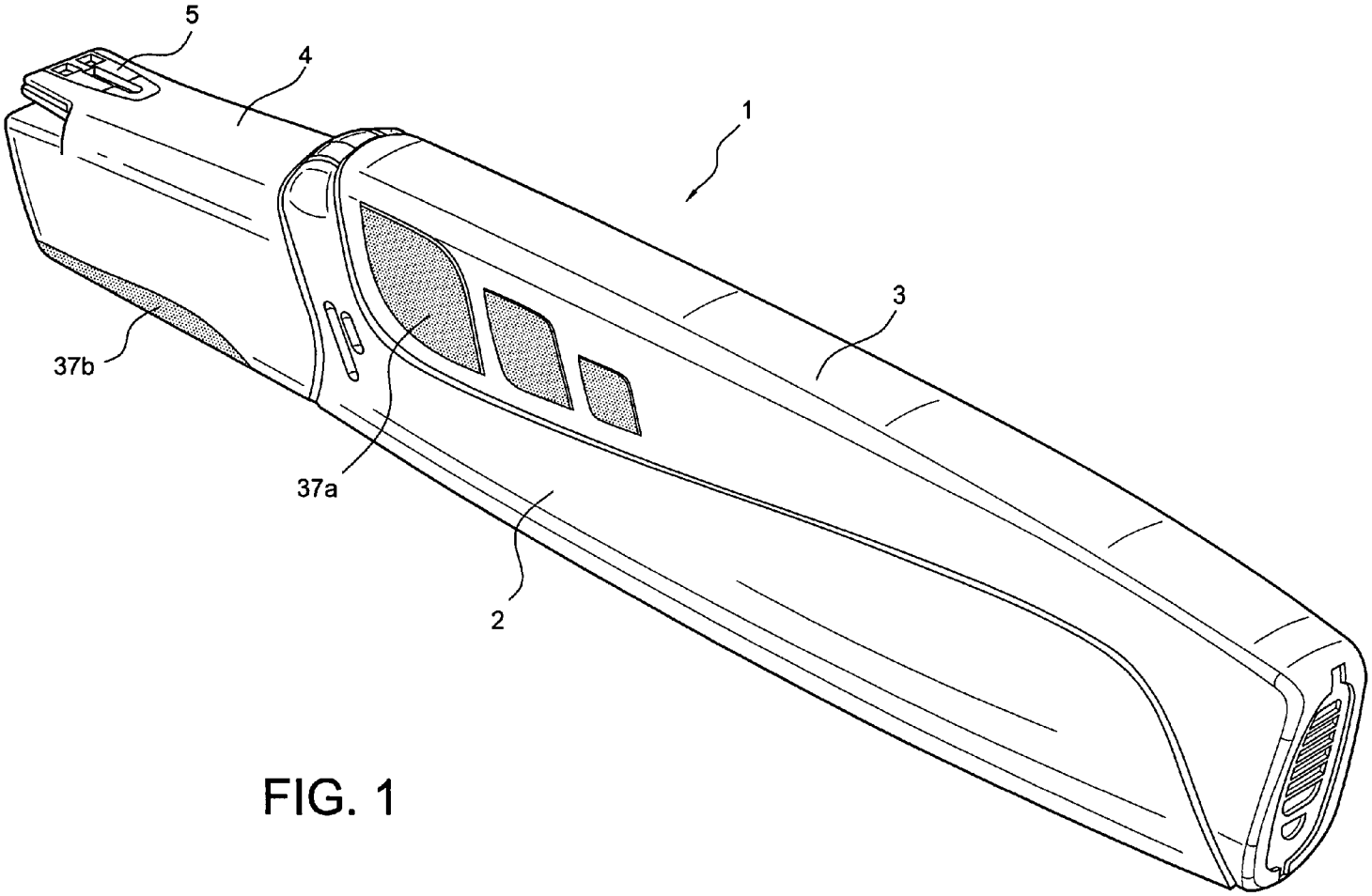
FIG. 1 shows a perspective view of a device according to the present invention, in folded state.

FIG. 1 shows an embodiment of a combined hygiene article according to the present invention, generally termed 1. The article 1 comprises a holder part 2, a first lid 3 and a second lid 4. On the second lid 4 there is a fastening means 5 for a razor head.

Figure 2:
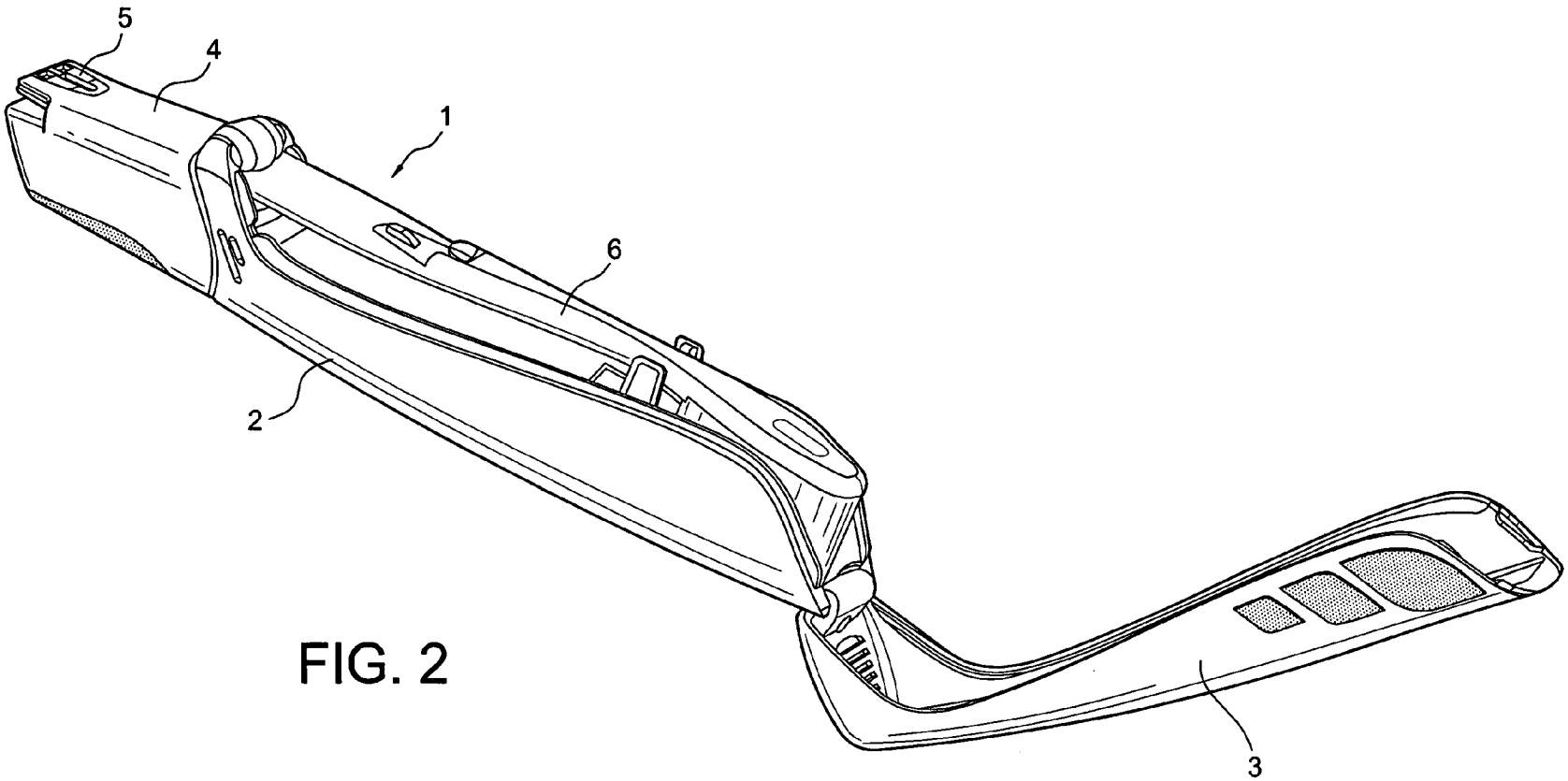
FIG. 2 shows the embodiment of FIG. 1, having the lid of the toothbrush-part open.

In FIG. 2 the first lid 3 is opened. This has a long shape and preferably a curved cross section having a substantial U-form. At this end, the first lid 3 is pivotally mounted to the holder part 2 in a way described further below.

When the first lid 3 is closed, it is shaped to fit to the holder part 2, in such a way that they form a substantially continuous surface. The holder part 2 has an inner skirt fitting into an outer skirt of the lid 3.

Figure 3:
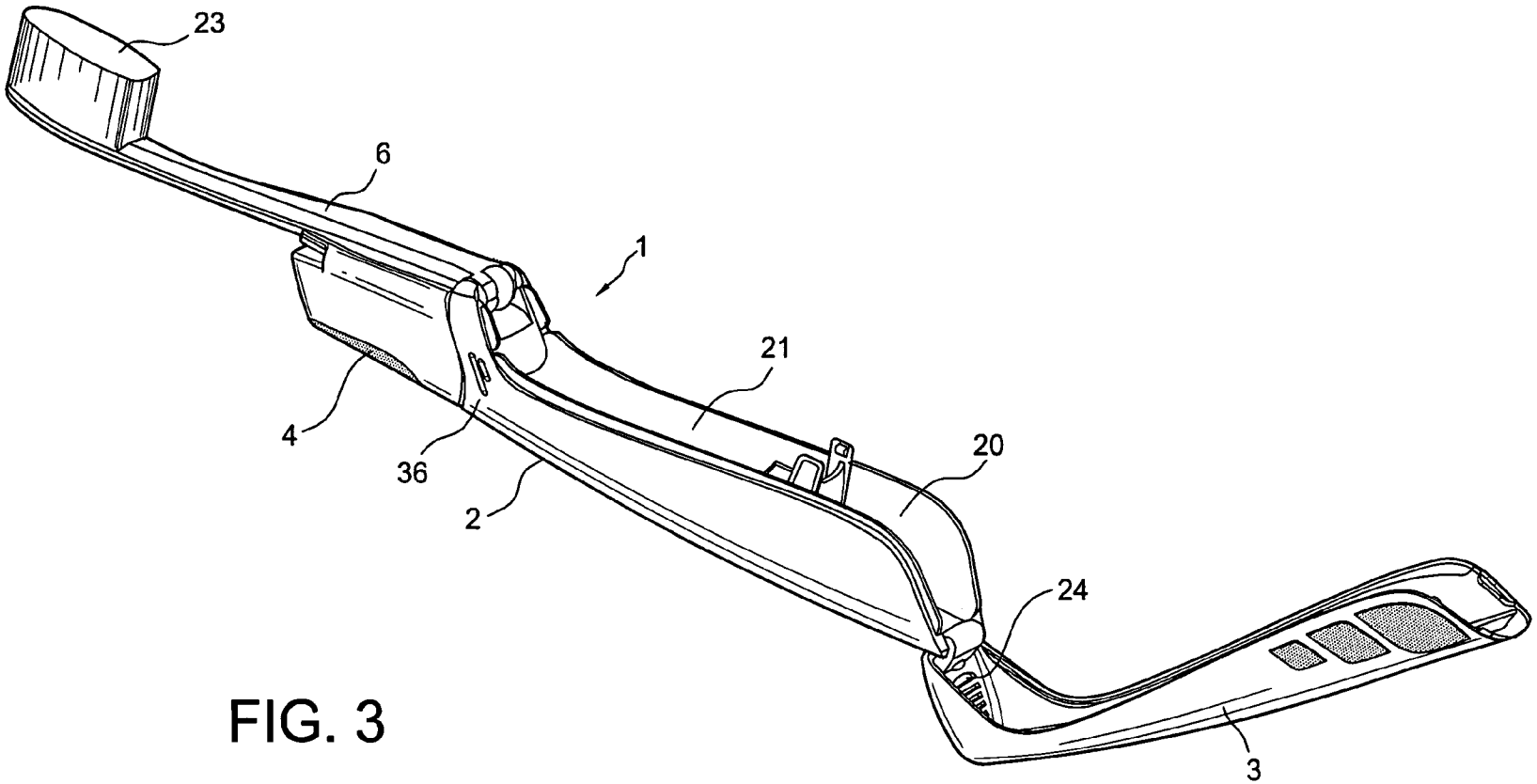
FIG. 3 shows the embodiment of FIG. 1, having the toothbrush part extended

A toothbrush-part 6 is hidden in the holder part 2, when the first lid 3 is closed (basic position). The toothbrush part 6 is pivotally fastened at its one end to the holder part 2, at a point being closer to the end of the holder part 2 being opposite to the end where the first lid 3 is pivotally fastened. The toothbrush part 6 can rotate ca 145° around its pivoting point, from totally folded position to totally extended position. In FIG. 3 the toothbrush part 6 is shown in totally extended position.

Figure 4:
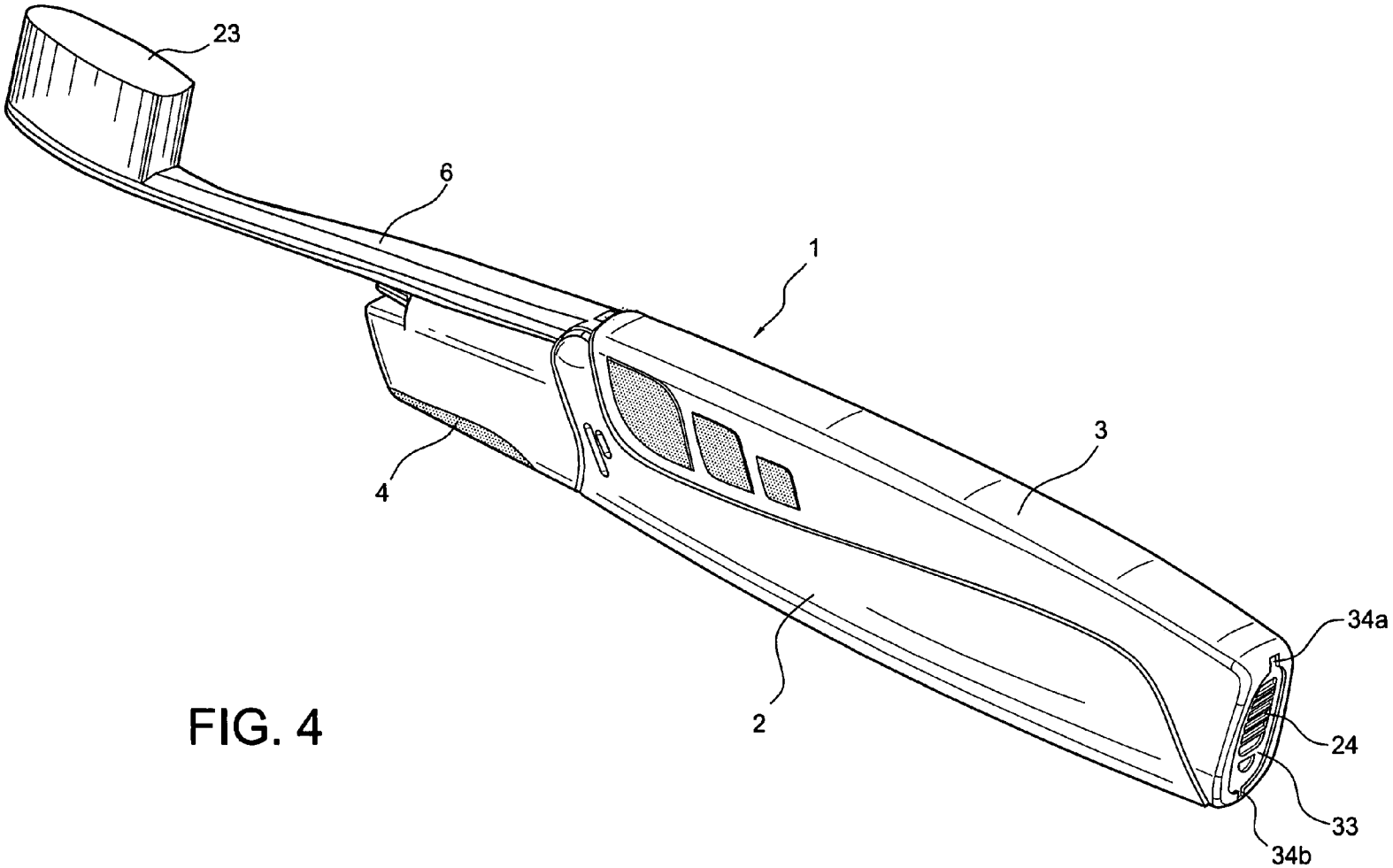
FIG. 4 shows the embodiment of FIG. 1, having the toothbrush part extended and the lid closed.

Once the toothbrush part is totally extended, the first lid 3 may be tilted into place, in such a way that the holder part 2 and the first lid 3 form a good grip for the user of the toothbrush. This is shown in FIG. 4.

Figure 5:
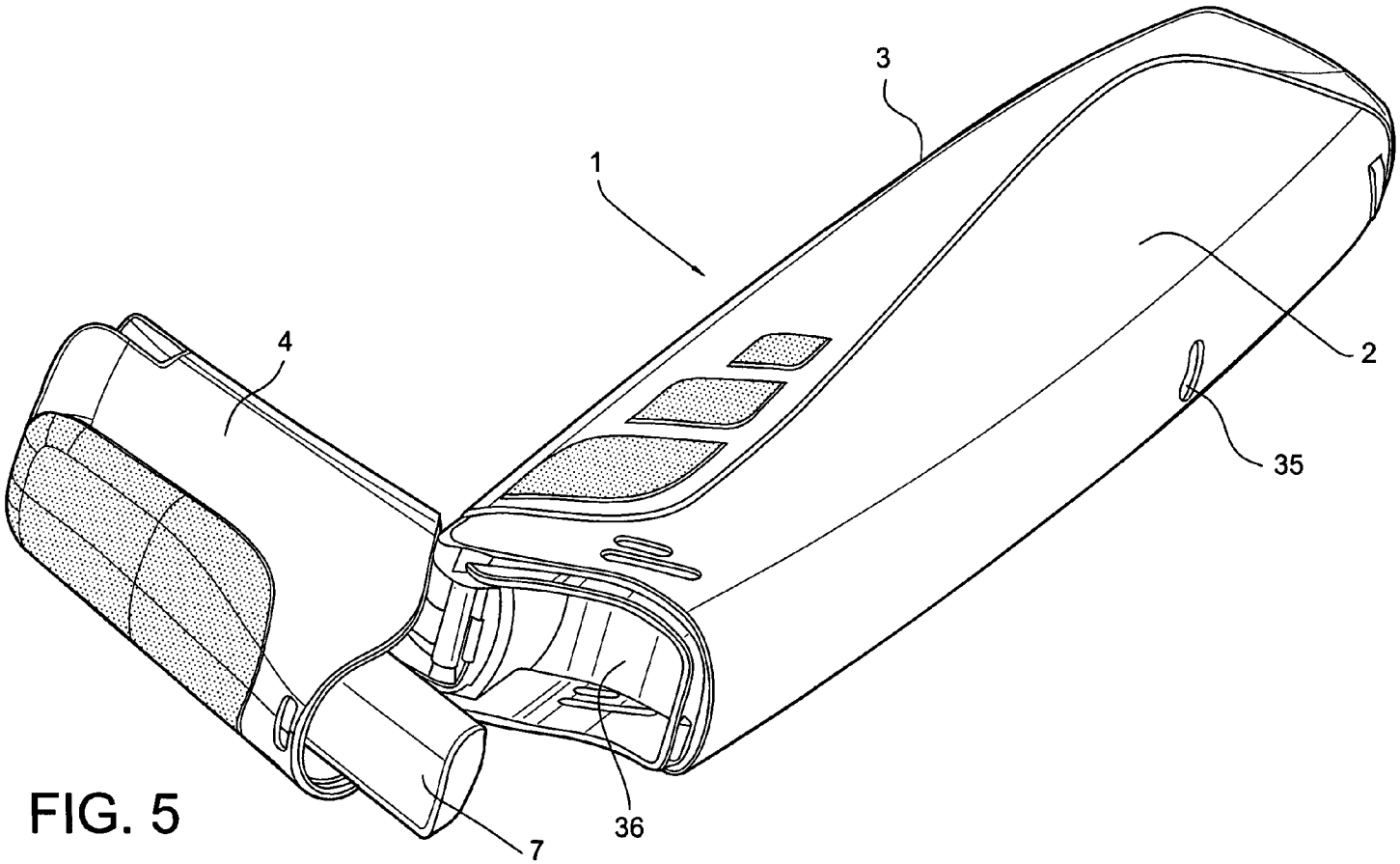
FIG. 5 shows the embodiment of FIG. 1, having the lid of the razor open.

FIG. 5 shows the second lid 4 in an open position. Inside the cavity being in the second lid 4, there is placed a razor head 7 of regular type. It is possible to use razor heads from different manufactures. The fastening means 5 is arranged to fit to a razor head 7 from a given manufacture, but it is within the scope of the invention, that this can be adjusted.

Figure 6:
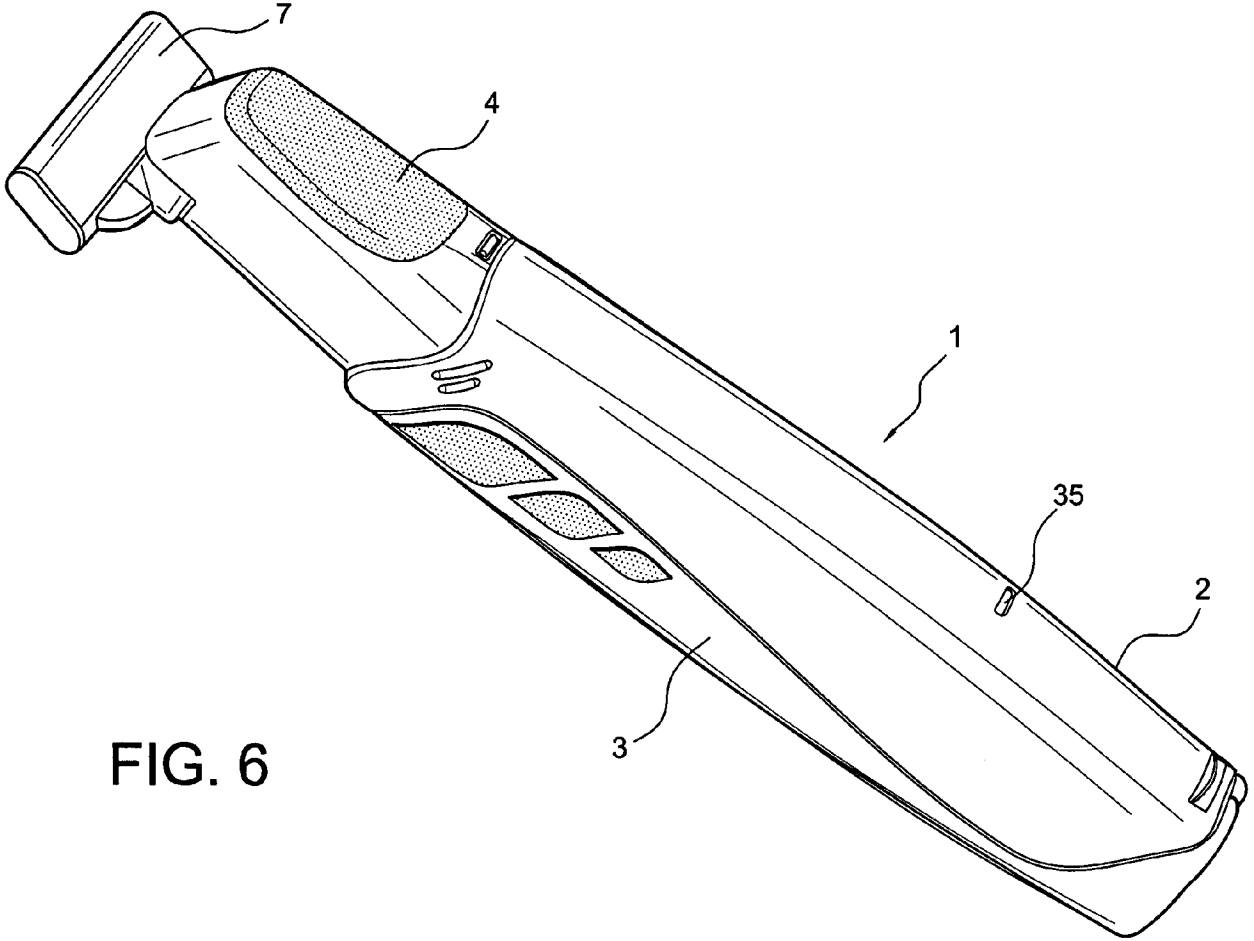
FIG. 6 shows the embodiment of FIG. 1, having the lid closed and the razor fastened.

When the razor head 7 is taken out of the second lid 4, the second lid 4 is closed, and the razor head is placed on the fastening means 5. This is shown in FIG. 6. The razor is now ready to use and the holder part constitutes a good grip.

Figure 7:
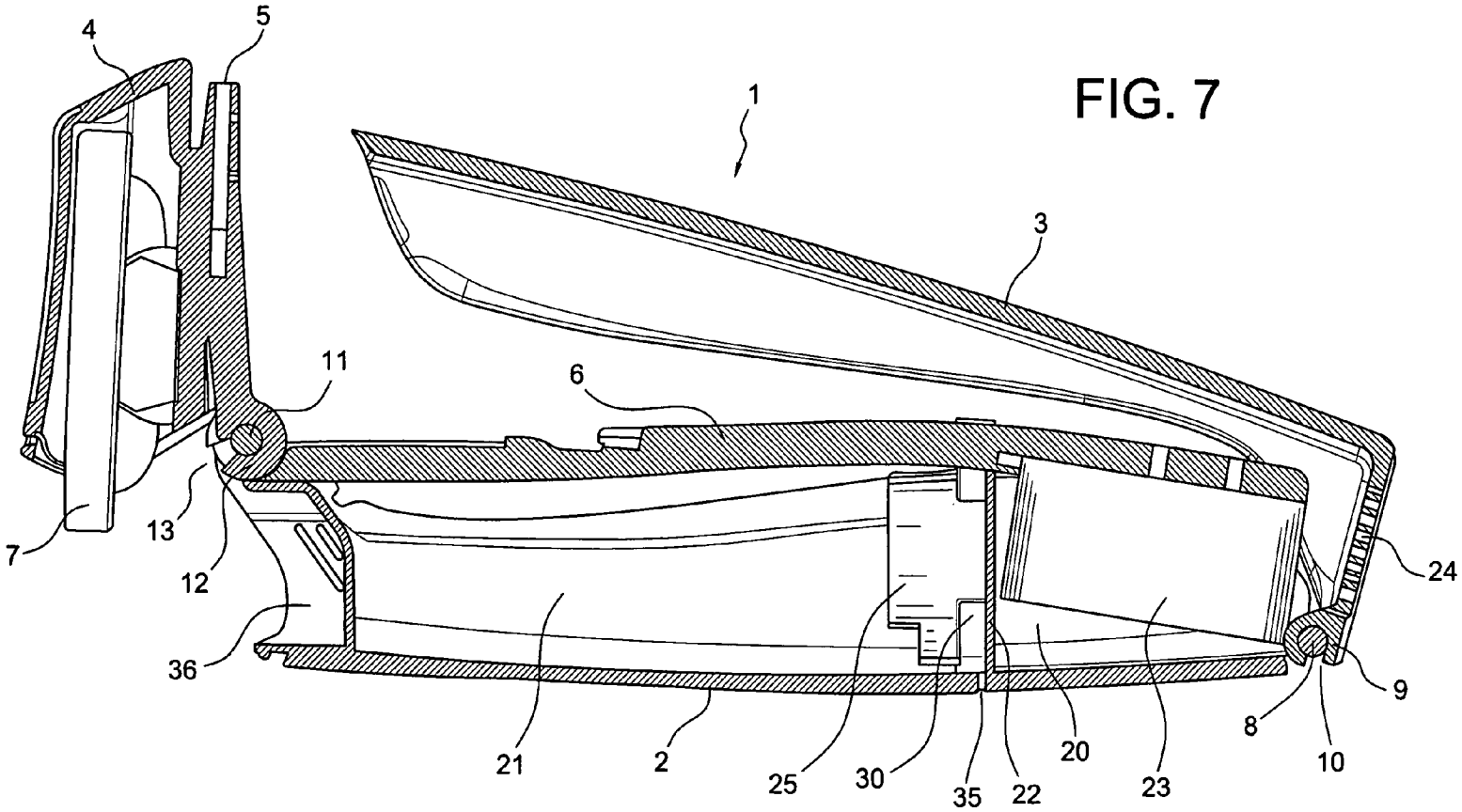
FIG. 7 shows the embodiment in a cut presentation, and with the lids open.

Referring to FIG. 7, it is arranged a first pin 8 in the holder part 2. On the first lid 3 there is arranged a first socket 9 having a partly open circle as cross section. The inner diameter of the first socket 9 is substantially the same size as the diameter of the pin 8. A slit 10 in the socket 9 has an aperture being somewhat smaller than the diameter of the pin 8.

When installing the lid 3 on the holder part 2, the slit 10 in the socket 9 is pressed against the pin, and will embrace the pin 8 with a click-operation. Correspondingly, the lid 3 may be departed from the holder part 2, both when desirable and unintentionally. In both cases the parts 2, 3 can easily be joined again, and held in place as before. This is shown in FIG. 8.

In a preferred embodiment, the lid 3 is arranged to create an angle to the holder part 2, of 130° to 160°, preferably 144°, upon opening. This opening angle is sufficient to extend the toothbrush holder 6 into using position, and at the same time large enough to ensure that the lid is not unintentionally broken off the pin.

The second lid 4 is fastened to the holder part 2 in a corresponding way as the first lid 3. Here, it is arranged a second pin 11 fitting into a second socket 12. The second socket 12 has a slit 13 with an aperture being somewhat smaller than the diameter of the second pin 11.

Figure 8:
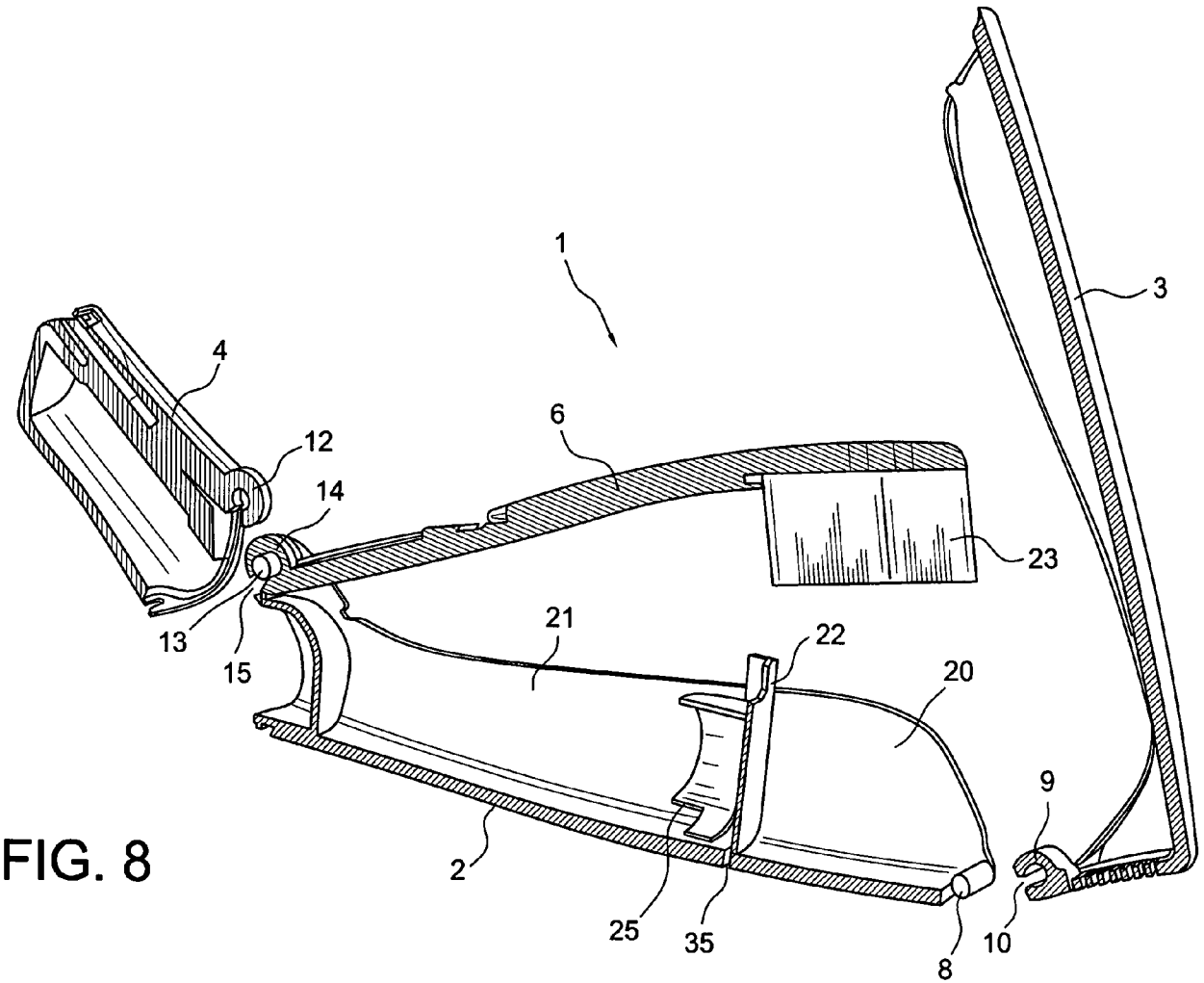
FIG. 8 shows the embodiment in a cut presentation, having the lids detached from the holder part.

As shown especially in FIG. 8, the toothbrush part 6 is also performed with a socket 14 having an aperture 15 and being fastened to the second pin. The socket 14 of the toothbrush part 6 is two-part, in such a way that the socket 12 of the second lid 4 slides in between the two parts.

As shown in FIGS. 3, 7 and 8, the cavity in the holder part 2 is divided into at least two rooms 20, 21 separated by a wall 22. The first room 20 is meant to embrace the toothbrush head 23 of the toothbrush part 6. When the combined article 1 is closed and not in use, the toothbrush head will thus be in a separate room 20. This room 20 is preferably performed with air/drain holes, so that the toothbrush head 23 can dry without the growth of bacteria. The holes should preferably be arranged so that they are open towards the surroundings and not into the other room 21. In the shown example there are a number of blowholes 24 at the end of the lid 3. Under the row of blowholes there is arranged a further hole 33. Between the hole 33 and the closest of the blowholes 24, one may, for instance, fasten a thin string, in such a way that the combined article for personal hygiene may be hung around the neck etc.

The row of blowholes 24 is on an end face being somewhat higher than the end of the lid 3. On each side of the end face there are arranged drain canals 34*a*, 34*b*. These have the function of draining any liquid flowing out through the blowholes 24 when the article is standing.

The other room 21 may for instance, embrace a tube of toothpaste or other small articles naturally belonging in the combined article.

Between the first room 20 and the second room 21, there is a compact wall 22. This wall 22 has a combined function. It both constitutes a physical border towards leaks of, for instance, shaving water, to the toothbrush head 23, and besides it performs a support/holder for a filling device 25 on the opposite side. This may be a filling device of the type described in NO patent application 20061062, described in further detail below.

In the holder part 3, it is arranged an air slit 35 into the other room 21. The air slit 35 is arranged close to the wall 22, and will function both regarding airing and draining of the other room 21. Further, there are arranged more blowholes 36 on both sides of the holder part 2, at the end being close to the second lid 4.

Figure 9:
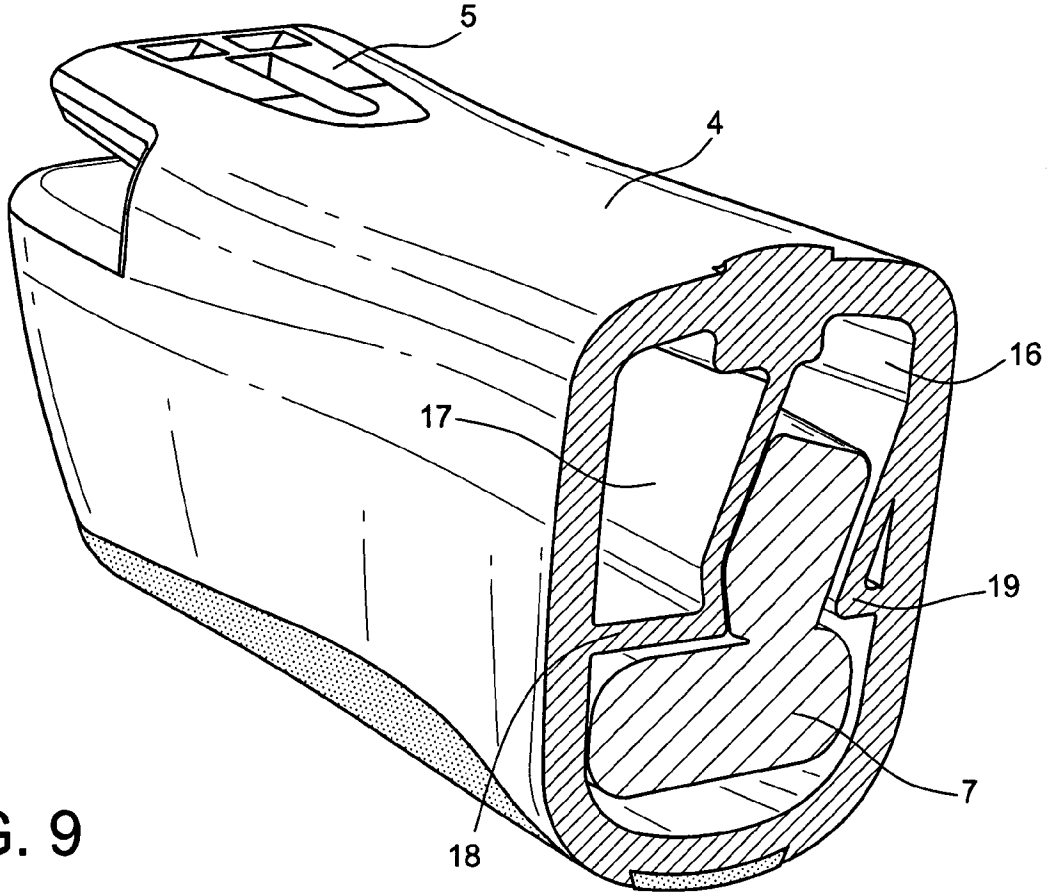
FIG. 9 shows a cut presentation of the second lid, with the razor head.

In a preferred embodiment, the second lid 14 is performed with a room division as shown in FIG. 9. The lid is mainly separated in two rooms 16 and 17, where room 16 is used as storage place for the razor head 7. The rooms 16, 17 are separated with a wall 18, in such a way that the shape of room 16 is adjusted to the shape of the razor head 7. Preferably, it is arranged a further extension 19 into the room 16. Based on the way room 16 is shaped, the part of the razor head containing the razor blade, will not get in touch with any of the surfaces of the room 16. Thus, the razor head dries while being stored in the room 16.

Figure 10B:
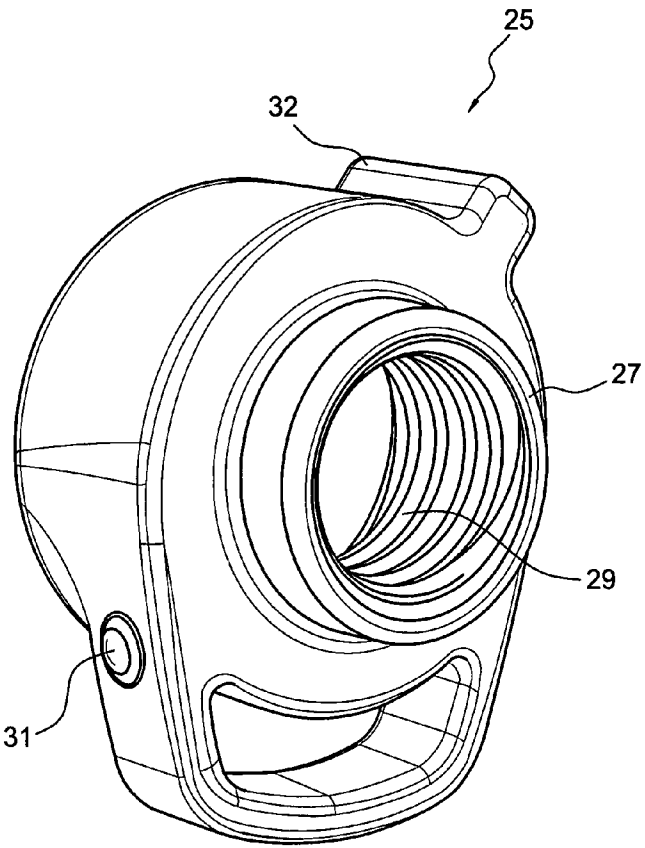
FIGS. 10*a* and 10*b* show the embodiment of the filler-device in perspective.
Figure 10A:
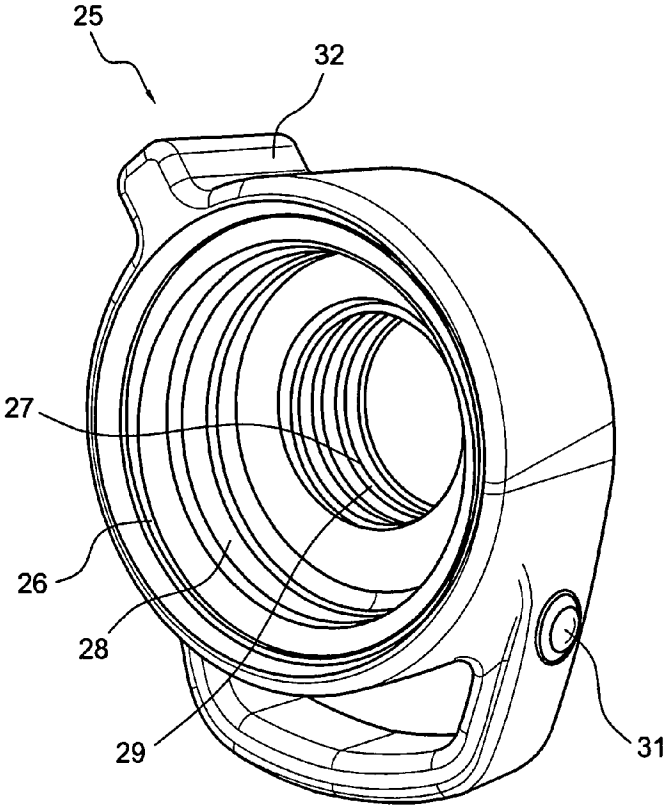

The filling device 25, being shown in FIGS. 10*a* and 10*b*, comprises a first pipe part 26, and a second pipe part 27. The pipe parts 26, 27 are equipped with inner threads 28, 29. The first pipe part 26 has threads 28 fitting to for instance, a standard tube of toothpaste, and the other pipe part 27 has threads fitting to a tube being smaller and which may be stored in the second room 21. The filling device may thus be used to fill the smaller tube being stored in the combined article, from a tube of standard size.

The wall 22 between the first room 20 and the second room 21, has a shape being adjusted to the shape of the filling device 25. In the shown embodiment, the wall 22, seen from the second room 21, has a depression 30 having an inner form corresponding to the outer shape of the filling device 25 at the other pipe end 27. The filling device 25 may easily be drawn from the fastening in the wall 22, and is secure there as long as it is not in use. FIGS. 10*a* and 10*b* also shows knobs 31, for keeping the filling device 25 better in place.

The toothbrush head 23 is preferably replaceable, for instance in that it is arranged a detent lock, known per se. A knob 32 is preferably arranged on the upper side of the filling device 25. This knob may be used to tip out the replaceable toothbrush head 23.

Friction surfaces 37*a*, 37*b* are preferably arranged on the first lid 3 and the second lid 4, respectively. These are performed in a two-component solution, and as a rubbery surface to among others, improve the grip of the combined article for personal hygiene.

The invention claimed is:

1. Combined article for personal hygiene, comprising a partly hollow holder part having first and second ends, a toothbrush part, and a fastener for a razor head, wherein the toothbrush part is arranged to fold into the holder part, as the toothbrush part has a first end being equipped with a hinge in such a way that the toothbrush part is pivotally fastened to the holder part and that the toothbrush part has a second end equipped with a toothbrush head, wherein said holder part comprises a wall, said wall being a physical separation between a first compartment and a second compartment, wherein, in a folded position, the toothbrush head is retained within the first compartment;

a lid pivotably connected to said second end of said holder part; and wherein said fastener for a razor head is arranged on said lid, which is arranged to fit in the elongation of the holder part, and which has an outer shape substantially corresponding to the shape of the holder part, and where the lid is hollow, and being separated into first and second compartments, wherein said second compartment of the lid is arranged to be a storage for the razor head, as the shape of the second compartment of the lid is adjusted to the shape of the razor head in such a way that the part of the razor head holding the razor blades does not get in contact with any surface of the second compartment of the lid.

2. Article according to claim 1, wherein an additional lid is arranged to be closed over the holder part both when the toothbrush part is folded and when the toothbrush part is extended, as the additional lid is pivotally fastened at the first end of the holder part, wherein the holder part has an inner skirt fitting into an outer skirt of the additional lid.

3. Article according to claim 1, comprising an air slit in the second compartment of the holder part, wherein the air slit is arranged close to the wall.

4. Article according to claim 2, wherein at least one blowhole is disposed proximate to a first end of the additional lid that is pivotally attached to said second end of said holder part.

5. Article according to claim 4, wherein said at least one blowhole is in an end face being higher than the first end of the additional lid, and that drain canals are arranged on each side of the end face.

6. Article according to claim 1, wherein at least two blowholes are disposed on each side of the holder part.

7. Article according to claim 2, wherein each side of the additional lid comprises first friction surfaces.

8. Article according to claim 1, wherein friction surfaces are arranged on an underside of the lid.

9. Article according to claim 8, wherein the friction surfaces are made of a two-component solution, and have a rubbery surface.

10. Article according to claim 4, wherein a row of blowholes are disposed at said first end of the additional lid.

11. Article according to claim 1, wherein a filling adapter is disposed on one side of the wall.

12. Article according to claim 1, wherein said first compartment of the holder part is proximal to said first end of said holder part, and said second compartment of the holder part is proximal to said second end of said holder part.

13. Combined article for personal hygiene, comprising:

a partly hollow holder part having a first end and a second end, and a wall separating a first compartment and a second compartment;

a first lid pivotally attached to a first pin on said first end of said holder part;

a second lid pivotally attached to a second pin on said second end of said holder part;

a toothbrush part having a toothbrush head disposed on an end thereof, said toothbrush part being pivotally attached to said second pin on said second end of said holder part; and wherein, in a folded position, the toothbrush head is retained within the first compartment of said holder part.

14. Article according to claim 13, wherein a fastener for a razor head is arranged on said second lid.

15. Article according to claim 14, wherein said razor head is pivotally connected to said second lid.

* * * * *